United States Patent [19]

Nishimura et al.

[11] 4,091,346

[45] May 23, 1978

[54] REED RELAY

[75] Inventors: Hiromi Nishimura; Kenji Ono; Minoru Shibata, all of Osaka, Japan

[73] Assignees: Matsushita Electric Works, Ltd., Osaka, Japan; Hans Sauer, Deisenhofen, Germany

[21] Appl. No.: 695,192

[22] Filed: Jun. 11, 1976

[30] Foreign Application Priority Data

| | | |
|---|---|---|
| Jun. 11, 1975 | Japan | 50-71118 |
| Mar. 31, 1976 | Japan | 51-35730 |

[51] Int. Cl.[2] ..... H01H 50/04

[52] U.S. Cl. ..... 335/78; 335/202

[58] Field of Search ..... 335/78, 79, 80, 132, 335/151, 153, 179, 202

[56] References Cited

U.S. PATENT DOCUMENTS

| | | | |
|---|---|---|---|
| 3,522,564 | 8/1970 | Mori et al. | 335/202 X |
| 3,843,892 | 10/1974 | Kobayashi et al. | 335/179 X |
| 3,987,383 | 10/1976 | Antonitsch | 335/78 |
| 3,993,971 | 11/1976 | Ono et al. | 335/202 |
| 4,032,871 | 6/1977 | Sauer | 335/151 X |

*Primary Examiner*—A. D. Pellinen

*Attorney, Agent, or Firm*—Beall & Jeffery

[57] ABSTRACT

A reed type relay comprises a frame forming a cavity and having coil terminals. A bobbin assembly containing a coil is mounted in the cavity, this assembly having a flange at each end. A pair of magnetic poles energized by a permanent magnet as well as by the coil is pressed into one of these flanges and the base end of a reed is pressed into the other. This reed is elongated and extends along the bobbin assembly with its tip located between the poles so as to be movable into engagement with each of them.

21 Claims, 35 Drawing Figures

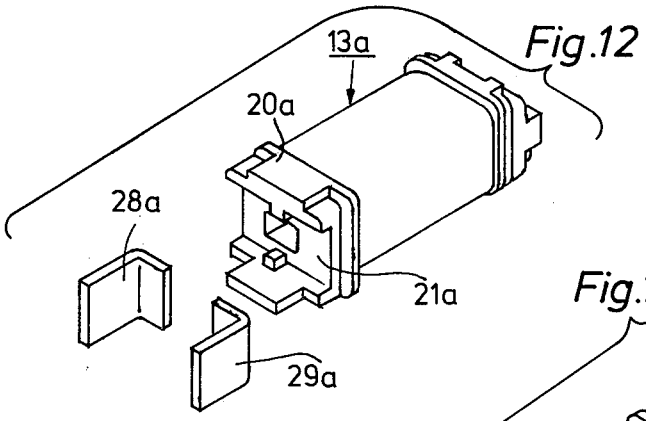
Fig.12
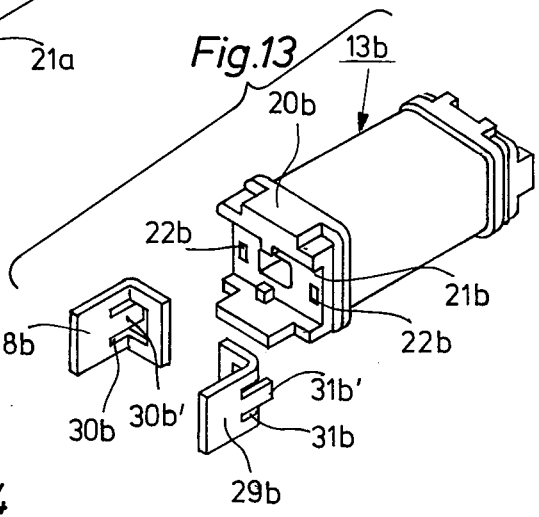
Fig.13
Fig.14
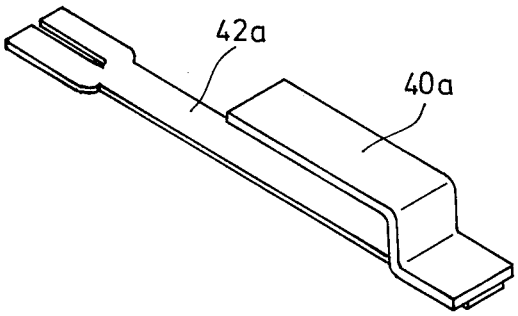
Fig.15
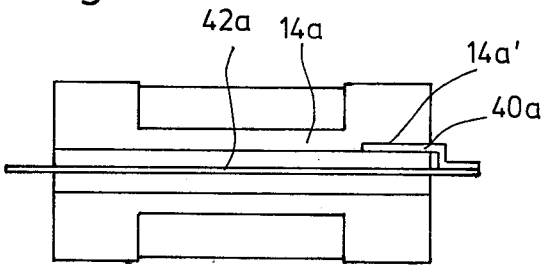

REED RELAY

This invention relates to reed relays.

Conventional reed relays of this kind are so constructed that the assembly is subjected to heat after adjustment for sensitivity as part of the completion process. As a result, it is difficult to achieve a high precision assembly with stabilized characteristics. Moreover, the construction is so complicated that it has proved difficult to make the apparatus as small as desired.

One object of the present invention is to provide a reed relay in which the above difficulties are minimised.

A further object of the present invention is to provide a relay structure in which all those parts which have a bearing on the operating characteristics of the relay are assembled on a first structural element, or "sub-assembly", while the terminals for electrically connecting the various parts to the external circuitry are embedded in a second structural element or "frame". As a result of such a structural separation, the relay sub-assembly with its rather complicated shape including all projections and recessions for receiving the functional parts of the relay (coil, reed, permanent magnet, magnetic pole pieces and contact terminals) may be molded as one integral piece from a suitable material such as a plastic in such a manner that the tolerances are kept to a minimum. On the other hand, the frame can be molded separately, e.g. from the same material, but in such a manner as is best suited for sealingly embedding the terminals for connection to the external circuitry.

The requirement for minimum tolerances (maximum accuracy) to be observed in the manufacture of the relay sub-assembly is considerably different from the requirement for providing a tight embedding of the terminals in the manufacture of the frame, for which no particularly close tolerances exist.

It is a serious problem to meet these two different requirements in a single molding step, and it is a further object of the present invention to provide a solution to this problem.

This problem is solved, according to the present invention, by making the relay from an assembly of two, separately constructed, structural elements, namely a first element in the form of a frame in which there is sealingly embedded metallic "frame" terminals for connections to external circuitry, and secondly a relay sub-assembly composed of the functional parts of the relay. The frame defines a cavity in which the relay sub-assembly is mounted in such a manner that electrical contact is made between the frame terminals, on the one hand, and terminals on the sub-assembly, on the other hand. The terminals on the relay sub-assembly will consist of "coil" terminals connected to the operating coil of the sub-assembly and "contact" terminals connected to switch contacts that similarly form part of the relay sub-assembly.

More specifically, the relay sub-assembly will itself comprise an elongated bobbin of molded electrically insulating material, on which bobbin the coil is wound. A pair of magnetic poles is mounted at one end of the bobbin and a permanent magnet co-operates with these poles to energize the same magnetically. An elongated reed extends along the bobbin, with its base end mounted at one end of the bobbin. The other end of the reed is located between the magnetic poles so as to be movable into engagement with the switch contacts upon energization of the coil.

Embodiments of the present invention are illustrated by way of example in the drawings in which.

Figure 11:
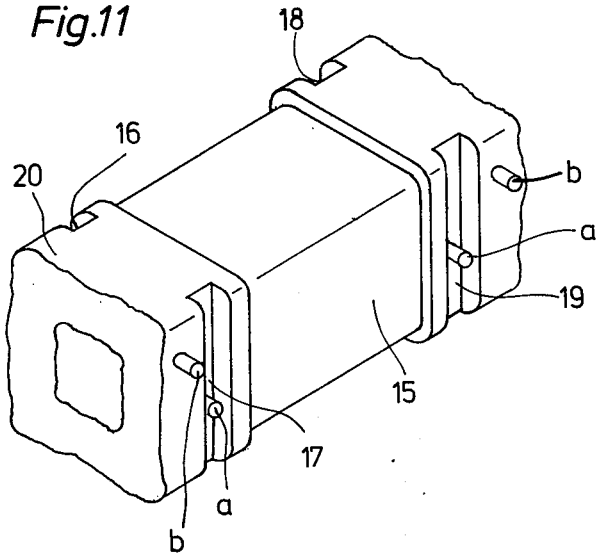
FIG. 11 is an enlarged, fragmentary perspective view of another embodiment of the present invention.
Figure 11B:
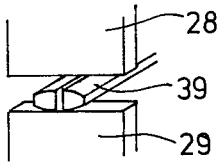
Figure 11A:
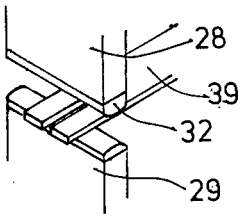
Figure 11A:
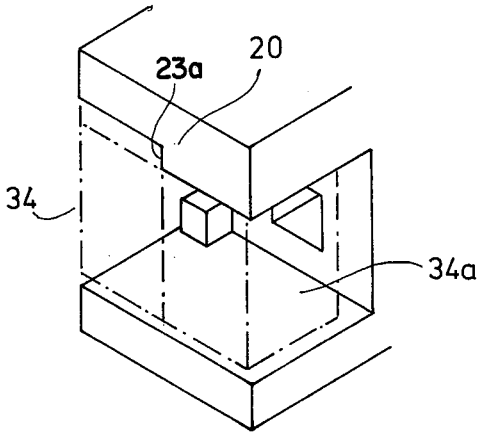
Figure 16:
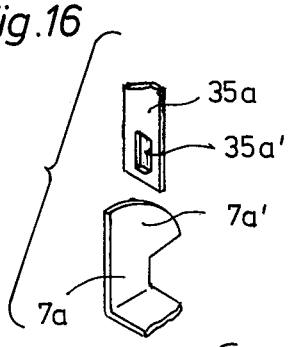
Figure 17:
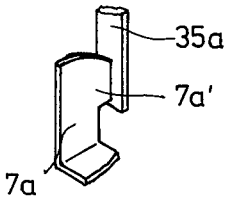
Figure 18:
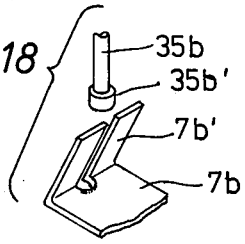
Figure 19:
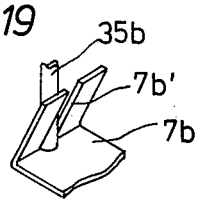
Figure 20:
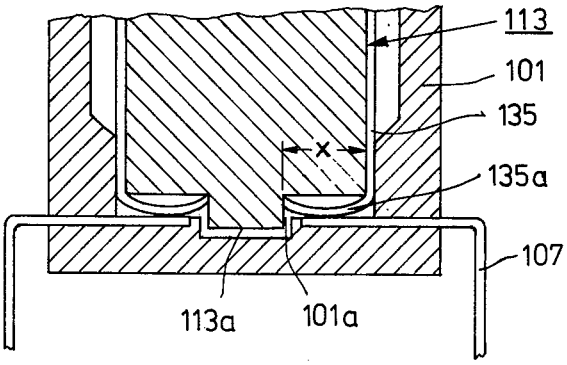
Figure 21:
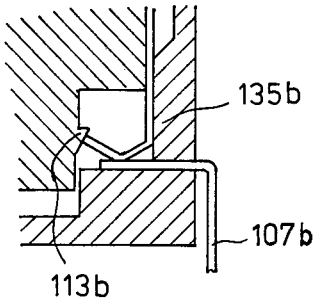
Figure 22:
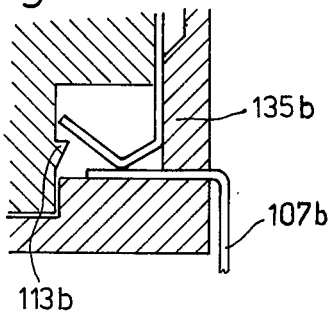
Figure 23:
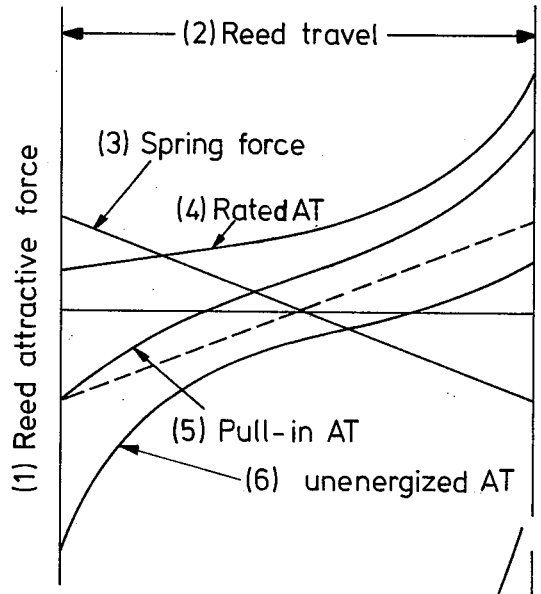
Figure 24:
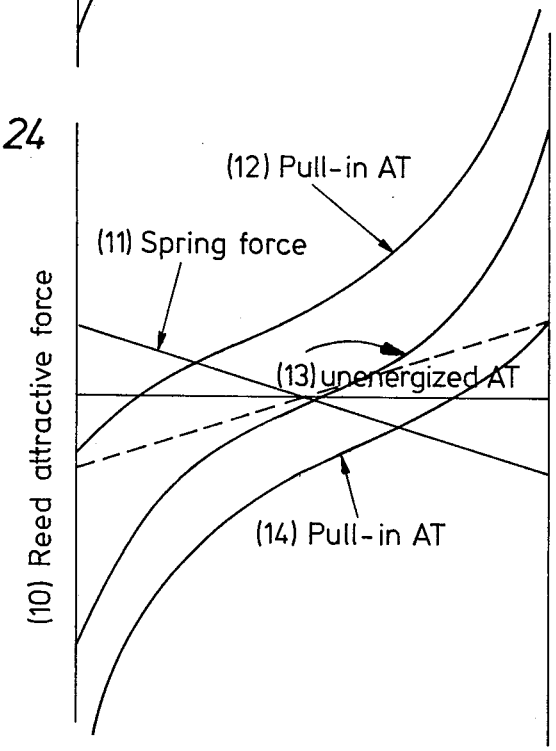
Figure 25:
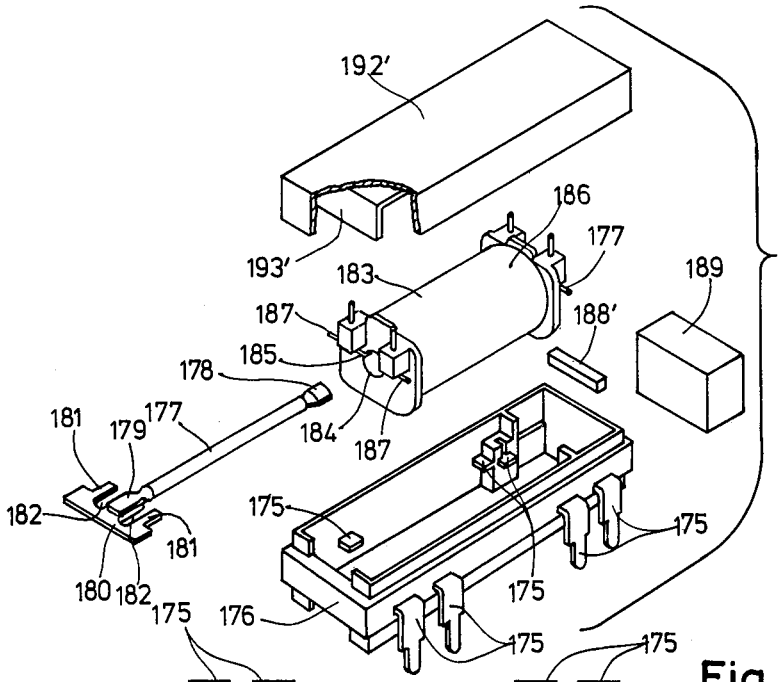
Figure 26:
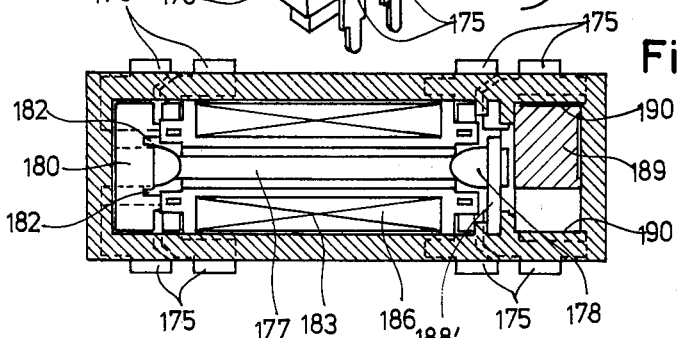
Figure 27:
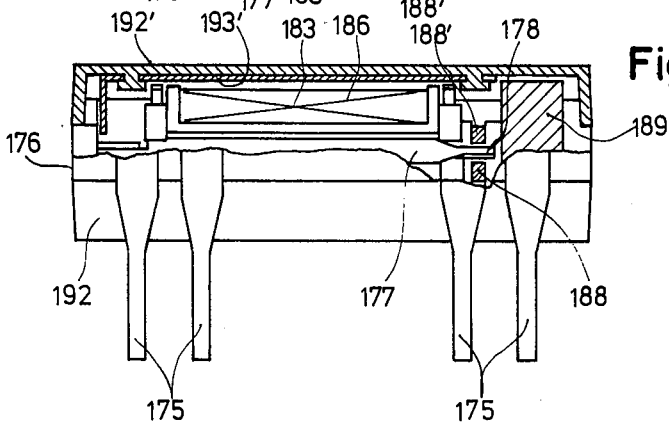
Figure 28:
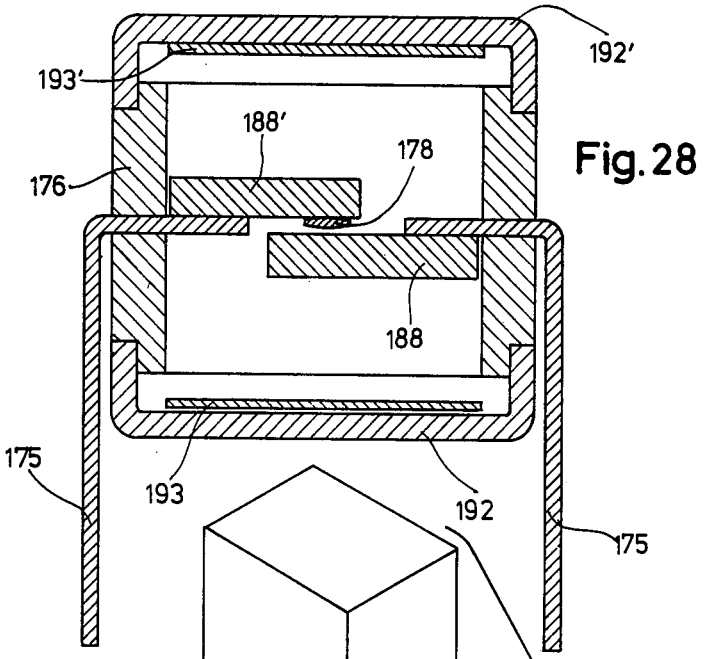
Figure 29:
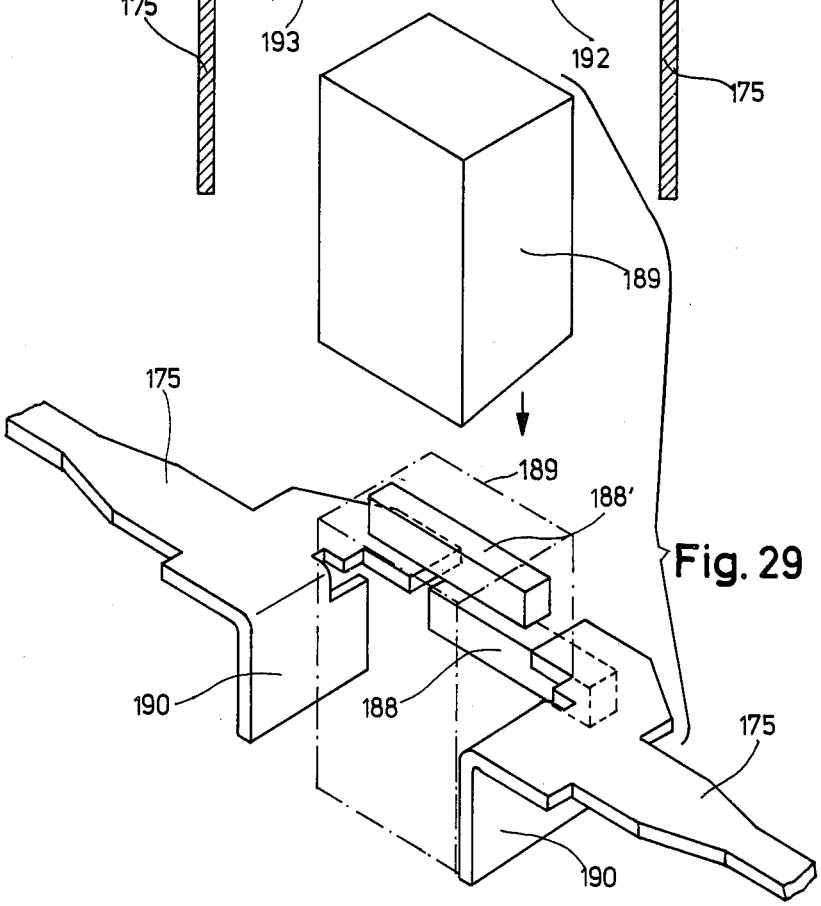
Figure 30:
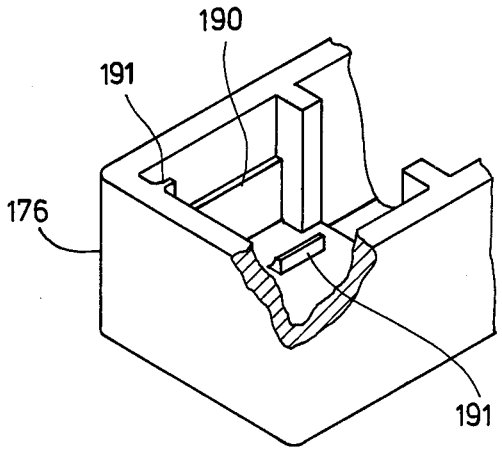
Figure 31:
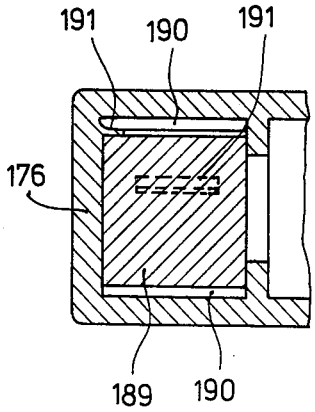
Figure 32:
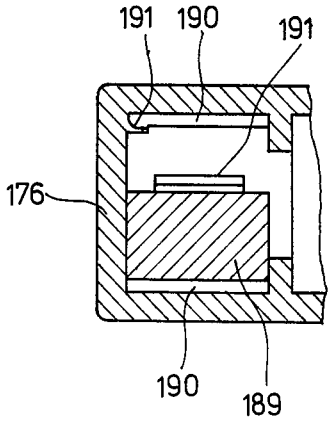

FIGS. 11*a*, 11*b*, 11*c* are further fragmentary views of parts associated with the embodiment of FIG. 11;

FIGS. 12 and 13 are exploded perspective views showing other embodiments of the present invention;

FIG. 14 is an enlarged, fragmentary perspective view illustrating another embodiment of the present invention;

FIG. 15 is a horizontal section further illustrating the embodiment of FIG. 14;

FIGS. 16 and 18 are fragmentary disassembled perspective views of other features;

FIGS. 17 and 19 are views corresponding respectively to FIGS. 16 and 18 and showing the parts assembled;

FIGS. 20 and 21 are fragmentary sectional views of other alternative features;

FIG. 22 corresponds to FIG. 21 when assembled;

FIGS. 23 and 24 are diagrams explaining the operation of the relay;

FIG. 25 is a perspective exploded view illustrating the assembly of a further reed relay embodying the invention;

FIGS. 26 and 27 are respectively a horizontal central section and a partially cut away side view of the assembled reed relay of FIG. 25;

FIG. 28 is a transverse section through the relay of FIG. 25 showing the fixed contacts;

FIG. 29 is a perspective exploded view illustrating mounting of a permanent magnet; and FIGS. 30, 31 and 32 are cut away and sectional fragmentary views illustrating alternative means for mounting the permanent magnet.

In FIGS. 1 to 10, 1 is a box like frame open at one side and defining a cavity 2. A terminal plate 3 which is partly exposed at the bottom of the cavity 2 is insert-molded. This terminal plate 3 is formed with cuts 4 between adjacent frames 1 for ease of separation. Once so separated each terminal plate 3 can be formed into fixed terminals 5 and 6, coil terminals 7, 8, 9 and 10 and common terminals 11 and 12. These terminals are bent in the same direction into two rows in the manner shown in FIGS. 4 and 5 to obtain a so-called dual-in-line terminal formation.

A coil bobbin assembly 13 or "relay sub-assembly" is made by winding a coil 15 on a hollow coil bobbin 14. Respective pairs of grooves 16, 17 and 18, 19 are provided opposite each other at the ends of the coil bobbin 14. A projection *a* is provided within each of these grooves and a coil end engaging projection *b* is provided adjacent each groove. Cut out portions 21 and 22 are formed opposite each other on the sides of an end flange 20 of the coil bobbin 14. A holding projection *c* extends into substantially the middle of each cut out portion. Holding pieces *d* are provided opposite each other on the upper and lower inside surfaces of said flange 20. An L-shaped magnet holding projection 23 extends from the upper part of the flange 20 and a second magnet holding projection 24 extends from the lower part. At the other end of the bobbin reed holding projections 26 an 27 (FIG. 2) project with a slight air gap *e* between them from a flange 25. The projection 26 is slightly smaller in height than the projection 27.

Magnetic poles 28, 29 are L-shaped and are pressed respectively into the cut out portions 21 and 22 of the flange 20, windows 30 and 31 being formed at the bends in these respective parts. Contact pieces *f* in the windows 30, 31 are pressed into contact with respective projections *c* when the magnetic poles 28 and 29 enter the cut out portions 21 and 22. Fixed contacts 32, 33 are spot-welded on the respective opposed surfaces of the magnetic poles 28 and 29, being formed as thin members plated on their entire surfaces with a contact material. These fixed contacts 32, 33 can have their contact surfaces *g* formed with inclined surfaces (see FIG. 11*a*) or as curved projecting surfaces, or may be plated as contact material directly on the opposed surfaces of the magnetic poles 28 and 29 without fixed contacts being separately providing.

Permanent magnets 34, 34*a* are formed preferably of BaFe having a getter effect. These two magnets are different from each other in length in the magnetizing direction. If the permanent magnet 34 is used (FIG. 11*c*), it is inserted between the magnet holding projections 23 and 24 (FIGS. 1 to 10) and arranged between magnetic pole 28 and step portion 23*a*. If the permanent magnet 34*a* (FIG. 6) is used it is inserted between projections 23 and 24, and arranged between magnetic poles 28 and 29. The permanent magnets 34 and 34*a* are provided alternatively so as to be able to achieve either a monostable or a bistable operation.

Figure 1:
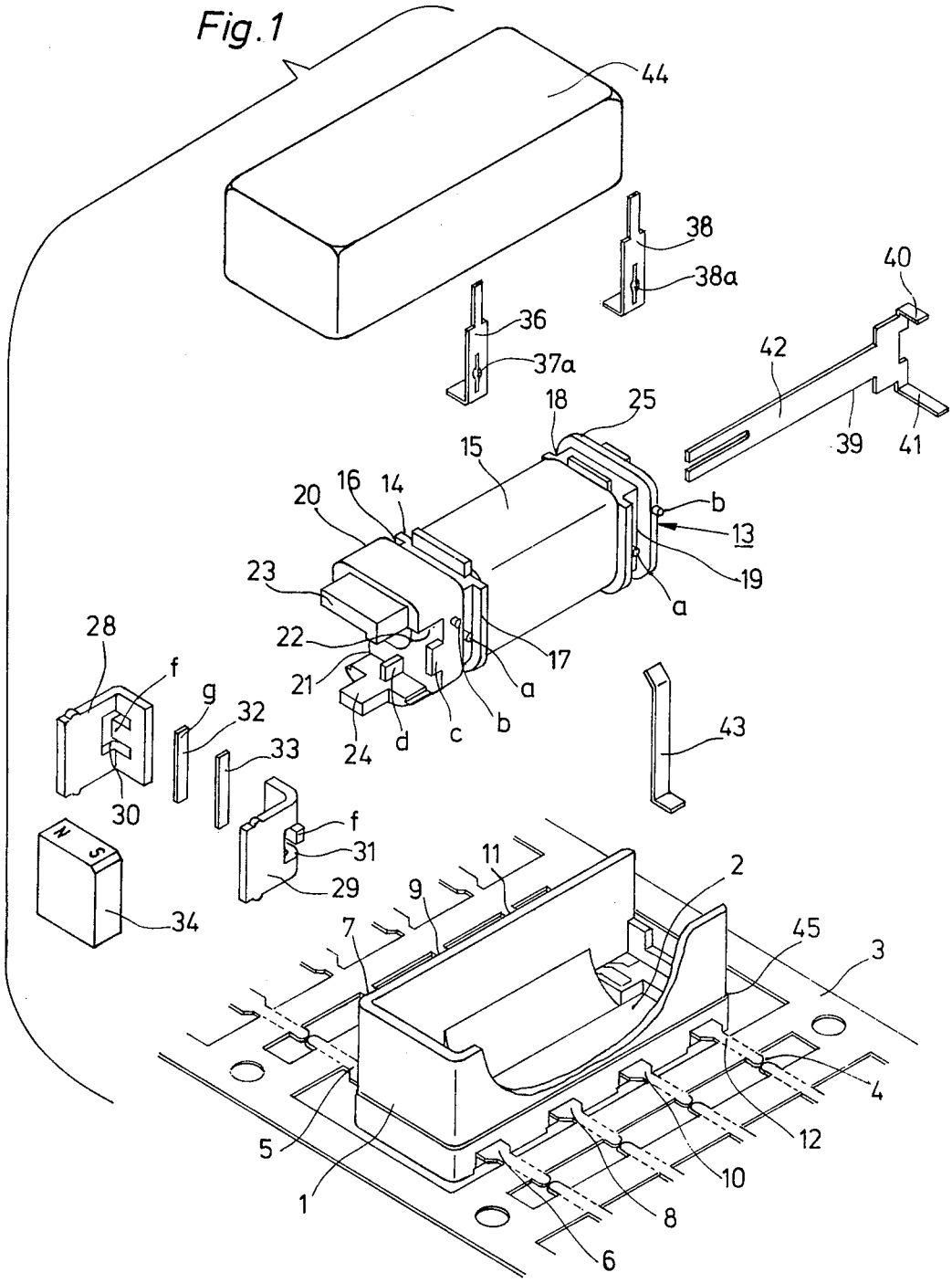
FIG. 1 is an exploded perspective view of a reed relay.
Figure 2:
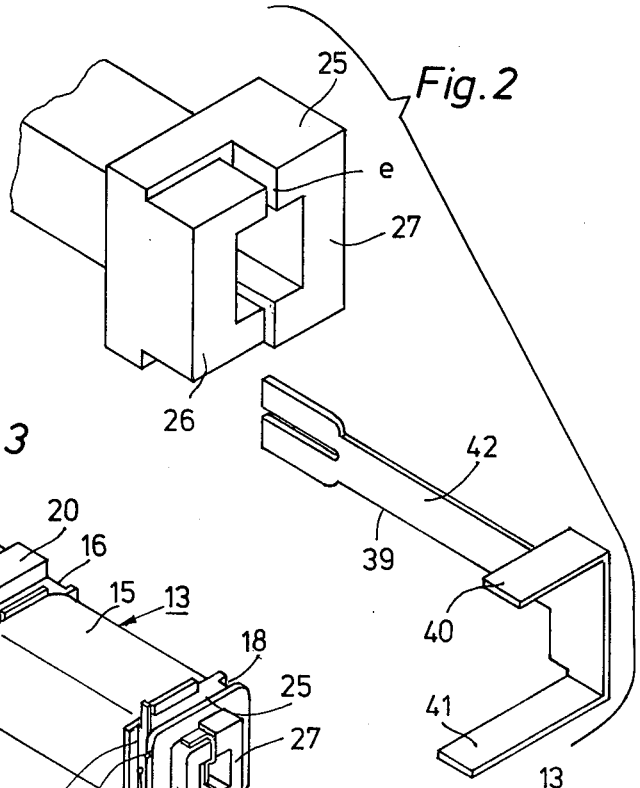
FIG. 2 is a perspective view of FIG. 1 seen from the rear and showing only two of the parts on an enlarged scale.
Figure 3:
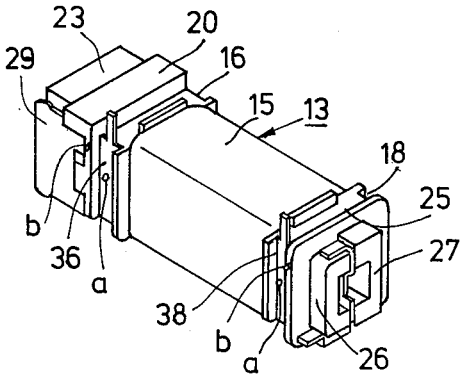
FIGS. 3 and 4 are partial assembled perspective views of the relay of FIG. 1.
Figure 4:
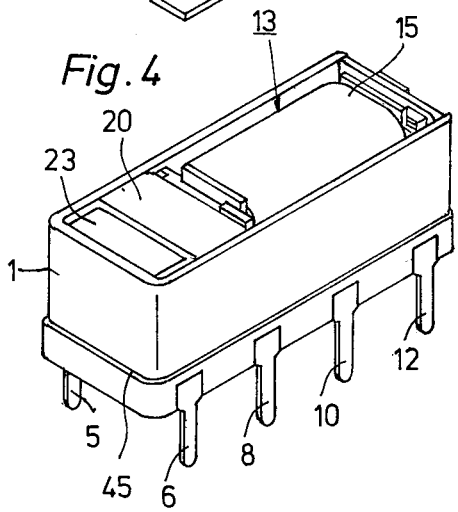
Figure 5:
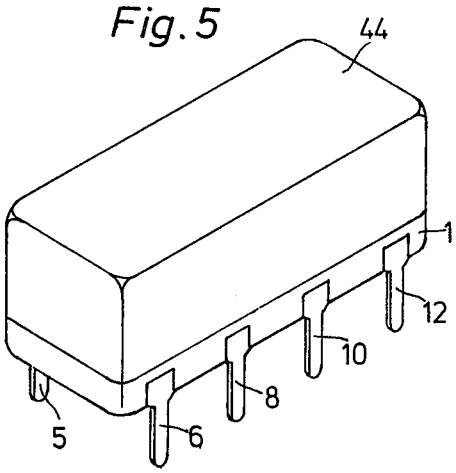
FIG. 5 is a perspective view of the assembled relay.
Figure 6:
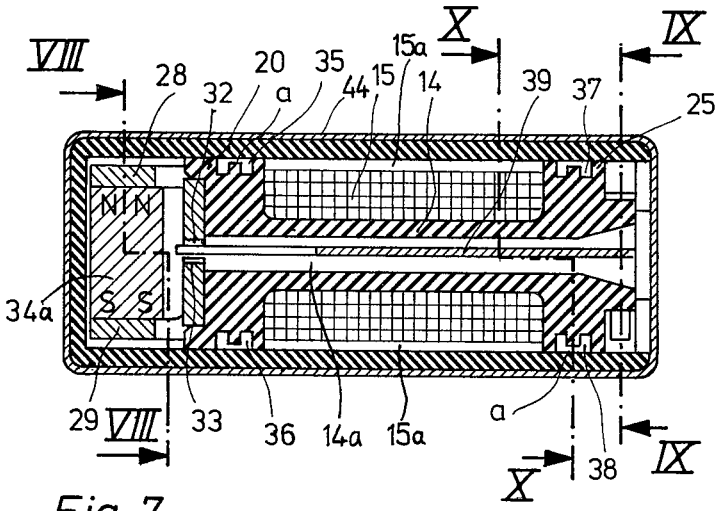
FIG. 6 is a horizontal central section of the relay.

Coil connecting terminals 35 to 38 are provided respectively with engaging holes 37*a* and 38*a* and are pressed into the grooves 16, 17, 18, 19 by fitting the holes over projections *a* in such grooves. A reed 39 is pressed into the air gap *e* between the reed holding projections 26 and 27 (FIG. 2). Bent pieces 40 and 41 projecting to one side of the base end of the reed 39 respectively contact the upper and lower surfaces of the projection 26. The body 42 of the reed 39 is forked at its tip, and is either fitted with foil or plated with a contact material. It is inserted into the coil bobbin assembly 13 so that its tip is positioned between the fixed contacts 32 and 33 (FIG. 6). The tip of the reed 39 may be formed with curved surfaces as shown in FIG. 11*b*.

A case 44 is applied with its lower edge in contact with a step 45 of the frame 1 and is preferably formed of a magnetic metal to shield against the influence of any external magnetic field. Alternatively, it may be molded of a plastic material with a magnetic shield plate provided within. An earthing terminal 43 is in contact at its bend upper end with the case 44 and at is L-shaped lower end with one of the common terminals 11.

Assembly of the relay is as follows:

Firstly the coil terminals 35, 36, 37 and 38 are pressed into the grooves 16, 17, 18 and 19 of the coil bobbin assembly 13 and the coil 15 is wound on this assembly. If the coil 15 is to be wound on the coil bobbin 14 is a single winding rather than a double winding, the number of coil terminals may be two. Each end of the coil 15 is soldered after being wound directly around the coil terminal or is spot-welded to the coil terminal after being wound around the coil end engaging projection *b* (see FIG. 11). The reed 39 is pressed into the air gap *e* between the projections 26 and 27 of the flange 25, and the magnetic poles 28 and 29 with the fixed contacts 32 and 33 are pressed into the cut out portions 21 and 22 of the other flange 20. At this time the fixed contacts 32 and 33 are brought into contact with the air gap holding pieces *d* and the contact pieces *f* of the windows 30 and 31 are brought into contact with the respective holding projections *c* so that a contact gap of high precision is obtained and the tip of the reed 39 can be positioned without any deviation. The permanent magnet 34 is then inserted between the magnetic poles 28 and 29.

Figure 7:
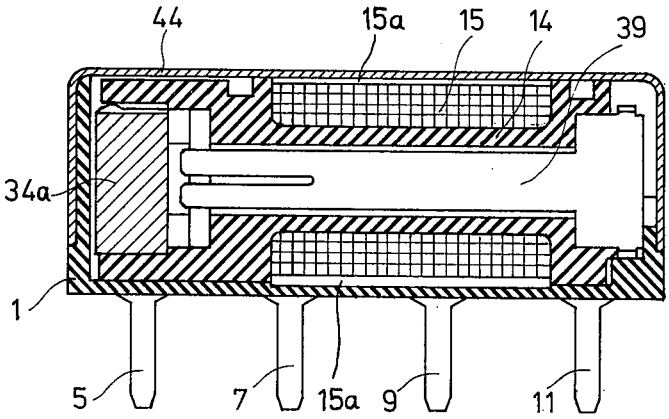
FIG. 7 is a vertical central section of the relay.
Figure 8:
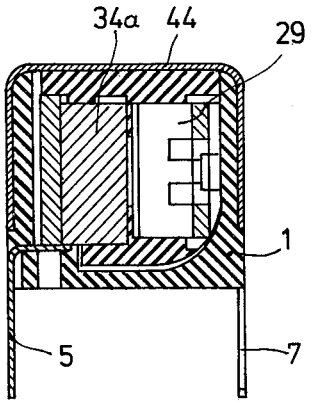
FIG. 8 is a section on line VIII—VIII in FIG. 6.
Figure 9:
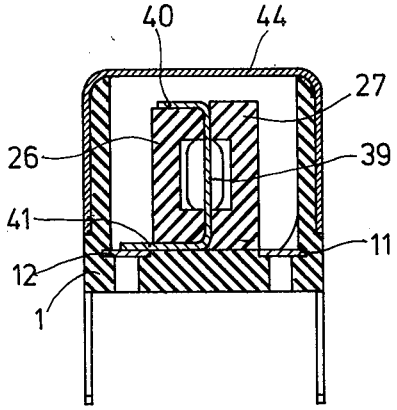
FIG. 9 is a section on line IX—IX in FIG. 6.
Figure 10:
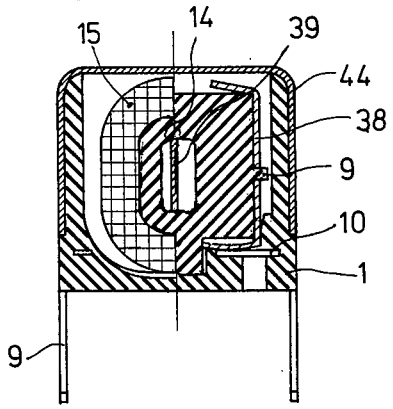
FIG. 10 is a section on line X—X in FIG. 6.

The terminals are then separated from the terminal plate 3 and bent to be aligned in two rows. The coil bobbin assembly 13 is placed in the cavity 2 in the frame 1 to which the earthing terminal 43 is spot-welded. The magnetic poles 28 and 29 and the bent pieces of the reed 39 are spot-welded to the corresponding terminals. At this time, the coil connecting terminals 35, 36, 37 and 38 are pressed into contact respectively with the exposed parts in the cavity 2 of the coil terminals 7, 8, 9 and 10 and therefore need not be welded. Finally, a binder is poured in from above the coil 15 to cover it. This binder is poured into the "coil winding range", which is the space 15*a* between the coil 15 and the frame 1 and between the coil 15 and the case 44 (FIGS. 6 and 7). The binder is poured into the coil winding range in such a manner as to permit adjustment of the sensitivity of the relay after the binder has been poured in, the coil winding range being kept separate from the "contact opening and closing range" which is the space 14*a* inside the bobbin 14 and around the contacts. Only the upper surfaces of the exposed parts of the terminals that are insert-molded in the frame 1 are covered with the binder to prevent the air-tightness from being reduced by the insert-molding. The assembly is then heated and vacuum-dried to cure the binder, anneal the frame and activate the permanent magnet formed of BaFe. The sensitivity of opening of the reed can be adjusted by varying the spring load of the reed, i.e. by twisting the fixed end of the reed. In contrast to prior arrangements in which adjustment was made prior to heating and was therefore vulnerable to the effects of the heating, in the present arrangement the characteristics are adjusted after heating. Lastly, the case 44 is painted or precoated with binder at the joining surface and is joined with the frame.

Various design modifications are possible. As shown in FIG. 12, in a coil bobbin assembly 13*a*, a recess 21*a* is formed in one flange 20*a* so that the bent portions of L-shaped magnetic poles 28*a* and 29*a* can be pressed into both end parts of said recess 21*a*. Also, as shown in FIG. 13, engaging holes 22*b* are made in the recess 21*b* in one flange 20*b* of the coil bobbin assembly 13*b*, projections 30*b*′ and 31*b*′ engaging respectively with said holes 22*b* being provided respectively in windows 30*b* and 31*b* of magnetic pole 28*b* and 29*b* so that these poles will be held and positioned more positively.

Furthermore, in the reed, the body may be separated and may be made of a wire (not illustrated) instead of the plate-shaped material shown, and may be made flat at both ends. One end may be made a contact surface and the other end may be joined with the part enclosing the bent piece. Moreover, as shown in FIGS. 14 and 15, a Z-shaped auxiliary piece 40*a* can be connected with a reed body 42*a* and inserted into a recess 14*a'* in a coil bobbin 14*a* as the reed is inserted through said coil bobbin 14*a*.

In addition, in connecting the coil connecting terminal and coil terminal with each other, as shown in FIG. 16, a coil terminal 7*a* is bent and formed with a hooked part 7*a'*, a slit 35*a'* being formed in one coil connecting terminal 35*a* so that the hooked part 7*a'* will engage the slit 35*a'* as shown in FIG. 17. Further, as shown in FIG. 18, an engaging slit 7*b'* can be formed in the bent part of a coil terminal 7*b*, a bar-shaped coil connecting terminal 35*b* having an enlarged stop 35*b'* at its end being provided to engage the slit 7*b'* as in FIG. 19.

Further, as shown in FIG. 20, a projection 113*a* can be formed on the bottom surface of a coil bobbin assembly 113, a corresponding recess 101*a* being provided on the inside bottom of a frame 101. The length of a bent part 135*a* of a coil terminal connecting terminal 135 is made larger than the distance *x* from the projection 113*a* to the side surface of the coil bobbin assembly so that the bent part 135*a* will be curved and will be pressed into contact with a coil terminal 107. As shown in FIG. 21, a bent part 135*b* having a sufficient length is made V-shaped so that, as the coil bobbin assembly 113 is being inserted, as shown in FIG. 21, this bent part 135*b* will be urged by a projection 113*b* and the inside surface of a frame 101*b* to be pressed into contact with a coil terminal 107*b* to stabilise contact therebetween.

In a reed relay as illustrated, when the coil 14 is excited, the tip of the reed 39 will rock between the fixed contacts 32 and 33. If, as shown in FIG. 11*a*, the permanent magnet 34 is connected to one magnetic pole 28 but is separated from the other magnetic pole, there will be obtained a mono-stable reed relay wherein, as shown in FIG. 23, when the coil 14 is not excited, the attraction of the permanent magnet 34 will overcome the spring load of the reed 39 and will keep the reed 39 attracted to the first contact 32 on the magnetic pole 28 side. When the coil 14 is excited, the reed will be attracted to the other fixed contact 33, but, when the excitation is interrupted, the original state will return.

Alternatively, if, as shown in FIG. 6, a permanent magnet 34*a* long in the magnetizing direction is joined with the other magnetic pole 29 and is arranged so as to give a magnetic force corresponding to the spring load of the reed 39, a bi-stable reed relay will be obtained wherein, as shown in FIG. 24, the reed will be maintained at the constantly excited and attracted fixed contact 32 or 33.

In FIGS. 23 and 24, the left hand verticals represent contact of the reed 39 with the fixed contact 32, the right hand vertical representing contact of such reed with the fixed contact 33. The horizontal lines indicate zero force acting on the reed. Values above these horizontals represent forces urging the reed towards contact 33; below, urging it towards contact 32. The symbol AT is short for ampere-turns and is hence a measure of magnetic motive force.

In FIG. 23, the curve 6, "unenergised AT", is the attractive force acting on the reed due to the permanent magnet 34 with no current in the coil 15. The curve 3, "spring force", is the force due to the stiffness of the reed and the dotted line is the reverse of the line 3 demonstrating that the arrangement is mono-stable, since the right hand end of this dotted line lies above the curve 6. Curve 5, the "pull-in AT", is the minimum energisation needed to move the reed from contact 32 to contact 33. Curve 4, the "rated AT" is the normal operating condition.

In FIG. 24, the example using the magnet 34*a*, curve 13 shows the unenergised AT, which will be seen at both ends to be greater than the spring force thus resulting in bi-stable operation. Curve 12 is the "pull-in AT" to move the reed from contact 32 to contact 33, while curve 14 is the "pull-in AT" to initiate movement from contact 33 to 32. Curve 11 and the dotted line correspond to curve 3 and the dotted line in FIG. 23.

The assembly of a further reed relay constructed according to an embodiment of the invention is described in greater detail with reference to FIGS. 25 to 27. The reference numeral 176 designates a frame which is open at its upper and lower sides and in whose side walls a plurality of connections 175 are embedded which, after the embedding process, are cut free and, as illustrated, are bent at right angles. The other ends of the connections 175 project into the hollow chamber formed by the frame. A rounded or convex contact 178 and a flat foot 179 are formed at opposite ends of a contact tongue or reed 177 made from magnetic material. The reference numeral 180 designates a mounting plate whose central portion is connected to the foot of the contact tongue 177. Projections 181 are formed on the mounting plate 180 on both sides of the central portion. Corresponding cuts 182 are provided between these projections 181 and the central portion. A coil former 183 having an opening 184 passing through it has, in the region of the outlet opening, a fixing groove 185 for receiving the projections 181. Numeral 186 designates a coil winding whose connections are conveyed from the coil former. Numerals 188 and 188' denote the upper and lower fixed contacts, which are square, are made from magnetic material and are plated with a precious metal, for example gold. Numeral 192' denotes the upper housing cap on whose inner side a screening plate 193' is mounted. The lower housing cap 192 which is also provided with a screening plate 193 is not shown in FIG. 25 but in FIG. 28.

FIG. 28 also shows the upper and lower fixed contacts 188', 188 in the assembled state. Both contacts, whose ends are fixed on the connections 175, are aligned so as to be parallel to one another and project from opposite sides of the inner wall of the frame 176 into the hollow chamber. The spacing of the fixed contacts is determined by the thickness of the connections 175. Fixed contacts and connections are connected, for example, by spot-welding. Numeral 189 designates a square sectioned permanent magnet. FIG. 29 shows the association of this magnet with the fixed contacts. The connections 175, which lie opposite to one another and project into the hollow chamber of the frame, are divided in two at their free end, one end of each being bent at right angles to form a vertical portion 190 so that the magnet 189 can be accommodated between them. The permanent magnet 189 may alternatively be clamped between a vertical portion 190 and a projection 191 (FIGS. 30 to 32) serving as a stop. The projection 191 is formed on the inner side of the frame (FIG. 30) and enables permanent magnets of differing sizes to be installed in the hollow chamber of the frame.

During assembly (FIG. 25), the contact tongue 177 is placed in the interior 184 of the coil former 183 so that the projections 181 of the mounting plate 180 are received in the fixing grooves 185. As a result, the free end of the contact tongue at the other end projects out of the coil 183 and is positioned approximately in the center of the coil former opening 184. The coil 183 with the contact tongue 177 is accommodated by the inner chamber of the frame 176, the ends 187 of the coil connections and the opposed ends of the mounting plate 180 being connected to the connections 175. The upper and lower fixed contacts 188, 188' are then arranged parallel to one another and are each connected by their underside to the fixed contacts 175, for example by spot-welding. The permanent magnet 189 is introduced between the vertical portions 190 of the connections 175 taking its polarity into account and is held laterally. The lower and upper housing caps 192, 192' are provided with locking or adhering means at the edges of their openings and are fixed on the lower and upper side of the frame 176.

The electrical values may be checked from the connections 175 at the upper and lower sides of the frame. Since the fixed contacts in this reed relay are protected by side walls, they cannot be adversely affected by the locking means, or the adhesive used to fix the housing caps 192, 192', which substantially contributes to the reliability of the relay. Since the frame has openings on the upper and lower side through which the coil and fixed contacts can be assembled, the coil ends and the fixed contacts may also be easily fixed to the connections. Since, furthermore, assembly and testing may be undertaken from the underside of the frame as well as from above, there is the possibility of simultaneously testing during assembly, which substantially increases economy. Automatic assembly is another possibility.

As FIG. 25 shows, the contact tongue 177 is formed from a piece of wire. Its contact region is convex or round in cross-section and is formed, for example, by pressing, so that single-sided contact with the fixed contacts is avoided. The electrical data may thus be kept within a narrow tolerance range. The contact tongue 177 is also fixed by the projections 181 of the mounting plate 180 in the fixing groove 185 of the coil former. The contact tongue 177 is therefore securely connected to the coil former so that assembly of this unit in the inner chamber of the frame is particularly simple. The contact force is also easily adjustable by means of the cuts 182 on the mounting plate of the contact tongue since these cuts enable the plate 180 to be twisted to adjust the alignment of the contact tongue.

In the fixed contact arrangement shown in FIG. 28 wherein the connections project into the inner chamber of the frame, the ends of bar- or rod-shaped upper and lower fixed contacts 188, 188' are disposed parallel to one another. The spacing between the contacts can be maintained particularly precisely, since it is predetermined by the thickness of the connections 175 and variations in the thickness of the connections or the sheet bar from which the latter are stamped are extremely small. Thus the electrical data of the relay are stable and this improves efficiency. An additional factor is that the fixed contacts are simple in form so that their manufacture and plating with contact material is simple and inexpensive.

As FIG. 29 shows, the permanent magnet 189 is fixed, in that the two sides of the magnet are located against the vertically angled portions 190 of the two-part ends of the connections which project into the inner chamber of the frame. The permanent magnet flux passes by way of one connection 175, the lower fixed contact 188, the contact region 178 of the contact tongue, the upper fixed contact 188' and the other connection 175 to actuate the contact tongue 177. The stable juxtaposition of the permanent magnet correspondingly improves the efficiency of the relay.

Finally, the permanent magnet 189 (FIGS. 30 to 32) may be mounted in that it can be clamped between projections 191 on the inner side of the frame 176 which serves as a stop and a vertical portion 190 of the connection 175. It is thus simple to install permanent magnets 189 of differing sizes, thus making it possible to construct relays of varying electrical data without altering the other constructional parts.

We claim:

1. A reed type relay comprising an assembly of two, separately constructed, structural elements, (a) a first of such elements comprising a frame of molded electrically insulating material having a plurality of metallic frame terminals sealingly embedded therein, said frame defining a cavity, (b) the second of such elements consisting of a relay sub-assembly comprising (i) an elongated bobbin of molded electrically insulating material, (ii) a coil wound on such bobbin and having coil terminals on the sub-assembly, (iii) a pair of magnetic poles mounted at one end of the bobbin, (iv) a plurality of electrical switch contacts associated with said poles, (v) a plurality of contact terminals on the subassembly respectively electrically connected to said switch contacts, (iv) permanent magnet means cooperating with said poles to energise the same magnetically, and (vii) an elongated reed extending along said bobbin, a base end of said reed being mounted at the other end of the bobbin in a free end of said reed being located between said poles so as to be movable into engagement with said switch contacts upon energisation of the coil, (c) said relay sub-assembly being mounted in said cavity with electrical contact between said frame terminals, on the one hand, and said coil terminals and contact terminals, on the other hand.

2. A relay according to claim 1, wherein said one end of the bobbin is formed with cut out portions into which said magnetic poles are engaged and with surfaces defining a gap between said poles.

3. A relay according to claim 1, wherein said one end of the bobbin is formed with recesses into which said magnetic poles are engaged and with holes in which projections on the poles engage.

4. A relay according to claim 1, wherein said one end of the bobbin has magnetic holding projections, a step portion being formed inside one said projection.

5. A relay according to claim 1, wherein each of said coil terminals is pressed into a groove in the sub-assembly and a portion of a said frame terminal is exposed on a bottom surface of said cavity to come into contact with a said coil terminal.

6. A relay according to claim 5, wherein said frame terminal is bent upwards and formed with a hooked part at its free end, the hooked part interfitting with a slit formed in the respective coil terminal.

7. A relay according to claim 5, wherein each end of the bobbin includes a projection adjacent a respective said groove, each end of the coil engaging said projection and being connected to a said coil terminal.

8. A relay according to claim 1, wherein a chamber housing said coil and a chamber housing said switch contacts are so formed as to be separated from each other, a binder closing said coil chamber, and the bobbin having an open portion adjacent the base end of the reed to enable adjustment of the reed after the binder has hardened.

9. A relay according to claim 8, wherein said permanent magnet means comprise a barium ferrite magnet, said magnet being located adjacent said switch contact chamber.

10. A relay according to claim 1, including a case closingly covering said frame, a grounding terminal being connected at one end to said case and at another end to a common terminal.

11. A relay according to claim 1, in which said free end of the reed has convex surfaces for engaging said switch contacts.

12. A relay according to claim , wherein the base end of the reed comprises a mounting plate having projections, said other end of the bobbin having cavities for receiving said projections.

13. A relay according to claim 12, in which slots are formed in the mounting plate to adjust the alignment of the reed.

14. A relay according to claim 1, in which said switch contacts comprise rod-shaped upper and lower fixed contacts disposed parallel to one another.

15. A relay according to claim 11, in which one of said contact terminals comprises two parts, one of which parts is bent at right angles to the other to form a vertical guide surface for the permanent magnet.

16. A relay according to claim 15 wherein said frame has projections, the permanent magnet means being clamped between said projections and the vertical guide surface of said one contact terminal.

17. A relay according to claim 1, wherein the frame member has upper and lower openings covered by respective closure caps.

18. A reed type relay comprising (a) a frame having a cavity therein and provided with coil terminals, (b) a bobbin assembly mounted in said cavity and having a coil wound thereon and a flange at each end, (c) a pair of magnetic poles pressed into a first said flange, (d) a permanent magnet for magnetic cooperation with said poles, and (e) an elongated reed extending along said bobbin assembly with its tip located between said poles so as to be movable into engagement therewith upon energisation of said coil, (f) said reed having a base end pressed into the other said flange, (g) in which the reed is a contact tongue cooperating with fixed contacts each connected to one of a plurality of contact terminals, the permanent magnet being being disposed in the vicinity of the fixed contacts, (h) in which the contact tongue is made from wire and is so formed that its contact region at one end has a convex cross-section, the contact tongue being housed in an interior space defined by the frame, and (i) in which projections provided on a mounting plate at a foot end of the contact tongue are received in a fixing groove at an entrance to an opening through the bobbin assembly, the coil being housed in said interior space.

19. A reed type relay according to claim 18 in which slots are formed in the mounting plate to adjust the alignment of the contact tongue.

20. A reed type relay comprising (a) a frame having a cavity therein and provided with coil terminals, (b) a bobbin assembly mounted in said cavity and having a coil wound thereon and a flange at each end, (c) a pair of magnetic poles pressed into a first said flange, (d) a permanent magnet for magnetic cooperation with said poles, and (e) an elongated reed extending along said bobbin assembly with its tip located between said poles so as to be movable into engagement therewith upon energisation of said coil, (f) said reed having a base end pressed into the other said flange, (g) in which the reed is a contact tongue cooperating with fixed contacts each connected to one of a plurality of contact terminals, the permanent magnet being disposed in the vicinity of the fixed contacts, (h) in which the contact tongue is made from wire and is so formed that its contact region at one end has a convex cross-section, the contact tongue being housed in an interior space defined by the frame, and (i) in which an exposed part of one of said contact terminals in said interior space comprises two parts, one of which parts is bent at right angles to the other to form a vertical guide surface for the permanent magnet.

21. A reed type relay according to claim 20 in which projections are provided on the frame within said interior space, the permanent magnet being clamped between the projections and the vertical guide surface of said one contact terminal.

* * * * *